United States Patent [19]

Butterworth

[11] 4,273,972

[45] Jun. 16, 1981

[54] JOYSTICK CONTROL ELECTRIC SWITCH

[75] Inventor: Edmund M. Butterworth, Bedford, England

[73] Assignee: Eaton Corporation, Cleveland, Ohio

[21] Appl. No.: 105,665

[22] Filed: Dec. 20, 1979

[30] Foreign Application Priority Data

Jan. 3, 1979 [GB] United Kingdom ..... 141/79

[51] Int. Cl.[3] ..... H01H 25/00

[52] U.S. Cl. ..... 200/6 A; 200/17 R; 200/153 K; 200/153 T

[58] Field of Search ..... 200/6 A, 18, 153 K, 200/330, 335, 339, 153 T

[56] References Cited

U.S. PATENT DOCUMENTS

| | | | |
|---|---|---|---|
| 2,521,489 | 9/1950 | Sorensen | 200/6 A X |
| 2,896,034 | 7/1959 | Nolden et al. | 200/6 A X |
| 2,987,720 | 5/1961 | Fisher | 200/6 A X |
| 3,024,664 | 3/1962 | Platz | 200/153 K X |
| 3,585,319 | 6/1971 | Payerle et al. | 200/6 A X |
| 3,639,705 | 2/1972 | Rayner | 200/6 A |
| 3,666,900 | 5/1972 | Rothweiler et al. | 200/6 A |
| 3,708,636 | 1/1973 | Sobchak | 200/6 A |

*Primary Examiner*—James R. Scott

*Attorney, Agent, or Firm*—R. J. McCloskey; H. R. Rather

[57] ABSTRACT

In a joystick controller for electric switches, a resilient bias is provided, biasing the joystick to its neutral position, by means of a garter spring which encircles and embraces two ring members, one ring member being displaced in its own plane in response to pivoting the joystick about its pivot and the other ring member being secured to a fixed housing part. The two ring members are profiled so that the garter spring rides from them upon pivoting the joystick through greater than a threshold angle from its neutral position, so that the bias is removed and the joystick stays put.

4 Claims, 3 Drawing Figures

JOYSTICK CONTROL ELECTRIC SWITCH

BACKGROUND OF THE INVENTION

This invention relates to a joystick controller for electric switches and provides for the joystick, a resilient biassing means which is relatively simple in construction as compared with prior art devices, yet is effective in operation.

SUMMARY OF THE INVENTION

This invention provides an electric switch joystick controller, comprising a joystick pivoted intermediate its opposite ends to fixed structure of the controller and manually movable from one of its ends about the pivot and co-operating at its other end with actuators of respective switches in predetermined pivotal positions of the joystick, and a pair of axially aligned ring members simultaneously embraced by an encircling resilient band, one ring member being immovable relative to the fixed structure of the controller and the other ring member being slidable radially relative to the fixed ring member upon pivoting of the joystick, so as to increase the tension in the resilient band as the joystick is pivoted further from its neutral position.

Thus, the resilient band provides a "spring return" biassing the joystick towards its neutral position. Preferably the resilient band is a garter spring. Preferably the two ring members are profiled so that, upon pivoting the joystick through greater than a threshold angle from its neutral position, the garter spring rides from the two ring members to no longer bias the joystick, towards its neutral position: thus, the joystick stays in this position until it is manually pivoted to a position within the threshold angle from the neutral position, whereat the garter spring rides again onto the two ring members to resume its biassing function.

A gate is preferably provided to constrain the joystick to pivotal movements in only predetermined directions from the neutral position. Some or all of the permitted directions of movement may allow sufficient displacement of the joystick that the joystick will stay in its displaced position until manually returned to a position within the threshold angle from the neutral position: in the remaining permitted directions, the allowed displacement is less than the threshold angle so that the return bias is always effective. Alternatively, the return bias may be always effective in all of the permitted directions of pivoting the joystick, in that in no direction is displacement greater than the threshold angle allowed by the gate.

BRIEF DESCRIPTION OF THE DRAWINGS

The electric switch joystick controller of this invention will be described with reference to the accompanying drawings, in which.

DESCRIPTION OF THE PREFERRED EMBODIMENT

Figure 1:
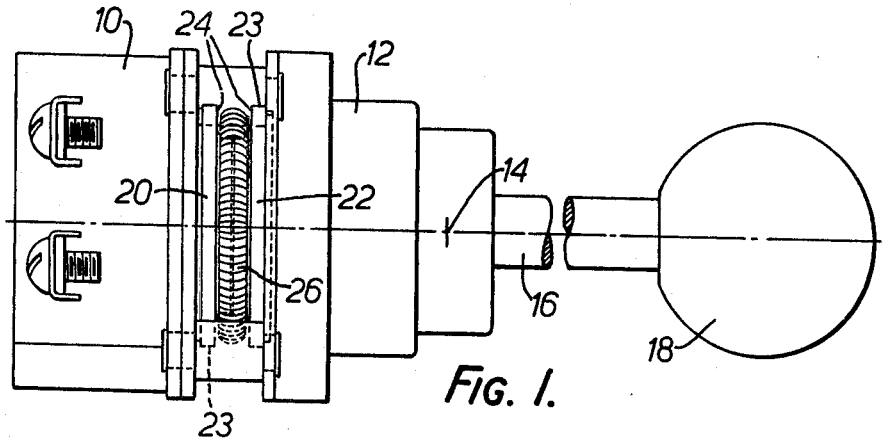
FIG. 1 is a diagrammatic side elevation of the embodiment of electric switch joystick controller with the joystick in the "off" or neutral position.

The electric switch joystick controller comprises fixed structure which in the embodiment shown comprises a housing part 10 for a plurality of electric switches 2,3 and a housing part 12 for a pivot indicated at 14 of a joystick 16 which extends through housing part 12. The pivot 14 is intermediate the opposite ends of the joystick 16 and comprises a spherical portion **16*a* on the joystick engaged between two half-spherical cups 12*a*,12*b*. The joystick is provided at one end with a knob 18** for manually pivoting the joystick and at the other end is arranged to co-operate with and depress the actuators of respective said switches, upon pivoting the joystick in appropriate directions.

Two ring members 20,22 are provided and one ring member 22 is secured to the housing part 12 and the other is slidably disposed between the housing part 10 and the fixed ring member 22. Ring 20 has a tubular projection **20*a* in which the end of the joystick engages so as to displace ring 20 radially in correspondence to the pivoting of the joystick from its neutral position (shown in FIG. 1), in which neutral position the two ring members are axially aligned. A chamfered projection 20*b* on the other side of the ring 20 engages the depressible actuators of the electric switches in the respective positions of the joystick. Each ring member comprises a first portion having a cylindrical outer surface 23 and an annular surface 24, and a second portion having an outer surface 25 of smaller diameter, joining the annular surface 24** in a smoothly curving profile and then gradually tapering in the direction towards the adjacent ring member.

The two ring members are simultaneously embraced by an encircling garter spring 26 (i.e. a metal coil spring extending full circle so as to be toroidal in form). In the neutral position of FIG. 1, the garter spring embraces the two ring members around their smaller diameter portions 25 and lies, with only small clearance, between the annular surfaces 24 of the two ring members. The garter spring is under initial tension.

Figure 2:
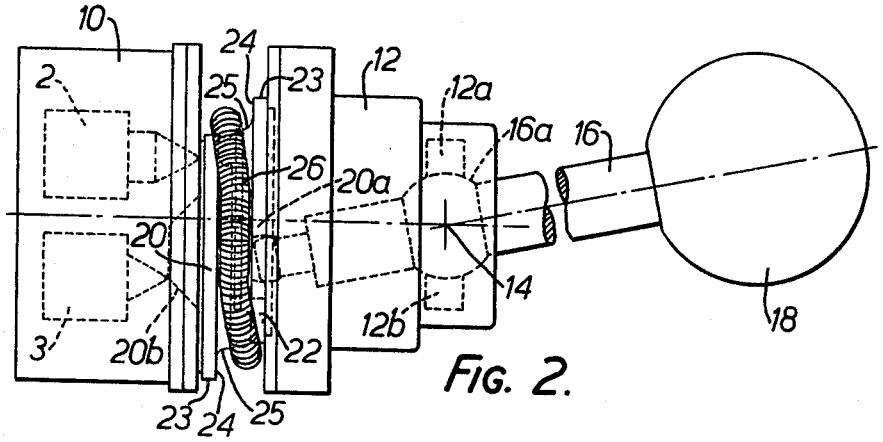
FIG. 2 is a similar view of the controller with the joystick pivotally displaced from its neutral position but subject to "spring return" bias towards its neutral position.

Any displacement of the joystick from its neutral position, by grasping the knob 18 and pivoting the joystick about its pivot 14 in any selected direction, serves to correspondingly radially displace the ring member 20. Such displacement of the ring member 20, being relative to the ring member 22, serves to stretch and further tension the garter spring and the garter spring therefore subjects the ring member 20 to abias serving to bias the joystick in the return direction, i.e. towards its neutral position. FIG. 2 shows the joystick at the maximum angle of displacement for which still a return bias is effective: the garter spring, at each of diametrically opposite points, is about to ride onto the surface 23 of one ring and the inner end 27 (see FIG. 3) of the other ring: however, the garter spring has sufficient bearing, at these diametrically opposite points, on the surfaces 25 of the respective ring member to exercise a return bias.

Figure 3:
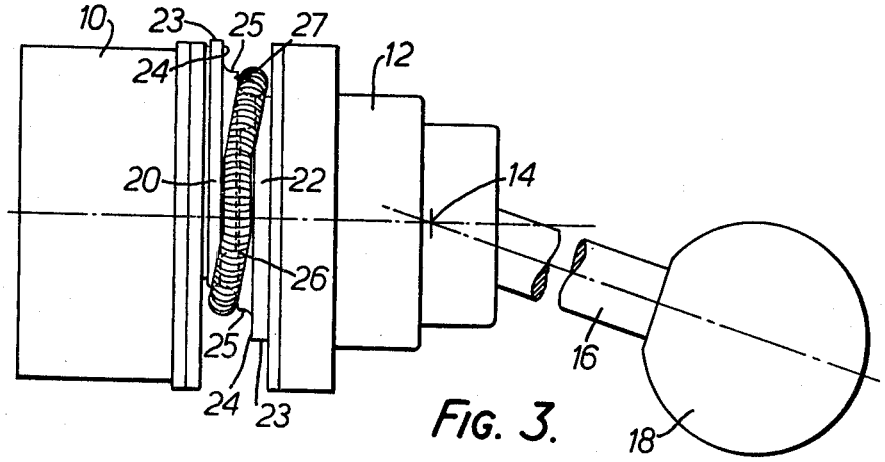
FIG. 3 is a similar view of the controller with the joystick pivotally displaced to a "stayput position" which is so far from the neutral position that the return bias is no longer effective.

FIG. 3 shows the joystick at a position beyond the threshold angular displacement shown in FIG. 2: thus, at each of the diametrically opposite points of the garter spring the spring has ridden completely onto the surface 23 of one ring member and onto the end 27 of the other ring member. The garter spring is no longer in contact, at these diametrically opposite points, with the surfaces 25 of the respective ring members and therefore no longer exercises a return bias. On the contrary, at the diametrically opposite points, the garter spring engages the surfaces 23 of the ring members in such a way as to bias the joystick away from its FIG. 1 neutral position, under the tension in the garter spring. Thus, the joystick will remain in its displaced position, or "stayput", until it is manually moved to a new position within the threshold angle from the neutral position, at which new position the return bias illustrated by FIG. 2 resumes.

A gate (not shown) is provided, either within housing part 10 or housing part 12, to constrain movements of the joystick to predetermined directions, the actuators of the electric switches being mounted in correspondence. The gate may allow sufficient displacement of the joystick in all premitted directions so that the "stayput" condition of FIG. 3 occurs, or otherwise only in some of the permitted directions (each of the remaining directions limiting the angular displacement to ensure that the return bias is always effective). Alternatively, the gate may prevent excessive angular displacement in all direction, so that no direction provides "stayput".

The controller may be arranged so that the joystick latches in the neutral position and so that inward movement of the joystick is applied before it can be moved in any of its permitted directions.

I claim:

1. An electric switch joystick controller, comprising:

(a) a joystick having opposite ends;

(b) pivoting means pivotally supporting the joystick intermediate its end so as to be manually movable from one of its ends about the pivot;

(c) electric switch means adjacent the other end of the joystick and having respective actuators cooperating with said other end of the joystick in predetermined pivotal positions of the joystick;

(d) a pair of axially aligned ring members, one ring member being fixed relative to said pivoting means and the other ring member being slidable radially relative to the fixed ring member upon pivoting of the joystick; and (e) a resilient band encircling the two ring members and providing a bias on the joystick, tending to return it to a neutral position.

2. An electric switch joystick controller as claimed in claim 1, in which the resilient band comprises a garter spring.

3. An electric switch as claimed in claim 1, comprising profiling on the two ring members to cause the resilient band to ride from the ring members upon pivoting the joystick through greater than a threshold angle from its neutral position, to no longer bias the joystick towards its neutral position.

4. An electric switch joystick controller as claimed in claim 3, in which each of the ring members comprises a first portion having an annular surface facing the other ring member and a second portion projecting towards the other ring member and having a circumferential surface generally tapering away from said annular surface, with the resilient band embracing the two rings over their said tapering surfaces.

* * * * *